US006100477A

United States Patent [19]

Randall et al.

[11] Patent Number: 6,100,477

[45] Date of Patent: Aug. 8, 2000

[54] RECESSED ETCH RF MICRO-ELECTRO-MECHANICAL SWITCH

[75] Inventors: John Neal Randall, Overijse, Belgium; Ming-Yih Kao, Dallas, Tex.

[73] Assignee: Texas Instruments Incorporated, Dallas, Tex.

[21] Appl. No.: 09/118,109

[22] Filed: Jul. 17, 1998

[51] Int. Cl.[7] ..... H01H 57/00

[52] U.S. Cl. ..... 200/181; 200/512; 73/510

[58] Field of Search ..... 200/512, 181, 200/269; 310/319, 328, 329; 333/262; 73/510, 504.04, 511, 514.21, 514.22

[56] References Cited

U.S. PATENT DOCUMENTS 4,598,181 7/1986 Selby ..... 200/512 X
5,258,591 11/1993 Buck ..... 200/181
5,367,136 11/1994 Buck ..... 200/600
5,383,364 1/1995 Takahashi et al. ..... 73/517
5,473,945 12/1995 Grieff et al. ..... 73/510
5,578,976 11/1996 Yao ..... 333/262

*Primary Examiner*—Renee S. Luebke
*Attorney, Agent, or Firm*—Ronald O. Neerings; Richard L. Donaldson; Frederick J. Telecky, Jr.

[57] ABSTRACT

A novel micro-electro-mechanical (MEMS) RF switch having a cavity (32) in a substrate (28) which creates a spacing between a conductive membrane (34) and a bottom electrode (38). The invention eliminates the need for the dielectric posts found in prior art MEMS RF switches, includes a flexure structure (36) in the membrane (34) which will reduce the required pull down voltage for the membrane, and reduces the stress and fatigue in the membrane due to switch activation.

23 Claims, 5 Drawing Sheets

RECESSED ETCH RF MICRO-ELECTRO-MECHANICAL SWITCH

TECHNICAL FIELD OF THE INVENTION

This invention relates to a micro-electro-mechanical (MEMS) RF switch and more specifically to the structure of such and to a process for fabricating such a switch using a recessed etch technique.

BACKGROUND OF THE INVENTION

An RF switch can be achieved by deflecting a metal membrane with an applied voltage so that the capacitance between two metal electrodes is dramatically changed. Fundamentally, such a switch is a reactive device so that the switch conducts RF signals when the capacitance is high and the capacitive reactance is low; i.e., $$X_c = \frac{1}{2\pi f c}$$

where $X_c$ is the capacitive reactance, f is the RF frequency, and c is the capacitance of the switch.

A thin dielectric can be used to separate the two electrodes so that a DC bias can be applied and maintained between them. The capacitance is a function of the area of the electrode and the spacing between the two metal electrodes; i.e., $$C = \frac{\varepsilon A}{s}$$

where $\epsilon$ is the dielectric constant for the insulator

A is the area of either of the two metal electrodes s is the spacing between the two electrodes, and C is the capacitance.

FIGS. 1 and 2 show a basic conventional MEMS switch mechanism for the OFF and ON conditions, respectively.

FIG. 1 shows a conventional MEMS RF switch in the OFF state. The switch structure is built on the chosen substrate 10 material and consists of two dielectric (insulator) posts 12. These posts have been constructed of both inorganic and organic polymer materials, both of which have problems. Problems with inorganic dielectric posts have been known to be related to stresses encountered with nitride or oxide layers in excess of a few microns thick. Organic polymers may be used as the post material but they tend to be less rigid and prone to degradation with time and environmental exposure. These dielectric posts support the flexible metal membrane 14 which is one plate of the capacitor. The second plate of the capacitor, the bottom electrode 16, is constructed on the surface of the substrate 10. A thin insulator, dielectric 18, is then placed on top of bottom electrode 16. An electrical connection is also made to the bottom electrode 16 for applying a DC bias 20, shown in the OFF state, to control the switch. Finally, connections are made for the RF input 22 signal and the RF output 26 signal. A fixed capacitor 24 is used to couple the switch structure to the RF output 26. In this state, there is no DC bias on the bottom electrode 16 and the membrane 14 is relaxed leaving a large separation between the two metal electrodes. This provides a low capacitance and high reactance condition which results in an OFF switch for RF signals.

FIG. 2 is the same structure as in FIG. 1, but now a DC bias 20 has been applied to the bottom electrode 16 to turn the switch ON. As shown, membrane 14 is now flexed down against the dielectric 18. This minimum separation between the two metal electrodes, membrane 14 and bottom electrode 16, yields a high capacitance and a low reactance resulting in an ON switch for RF signals.

Several of the problems associated with conventional MEMS RF switches include:

1. the need to fabricate tall posts to support the membrane
2. a requirement for a relatively large voltage to pull down the membrane to activate the switch, and
3. the stress placed on the membrane material when it is pulled down.

Representative prior structures are discussed in U.S. Pat. Nos. 5,578,976; 5,367,136; and 5,258,591. None of these patents disclose or suggest the novel features of the present invention.

SUMMARY OF THE INVENTION

A novel micro-electro-mechanical (MEMS) RF switch having a recessed area in a substrate which creates a spacing between a conductive membrane and a bottom electrode. The invention eliminates the need for the dielectric posts found in prior art MEMS RF switches, includes a flexure structure in the membrane which will reduce the required pull down voltage for the membrane, and reduces the stress and fatigue in the membrane due to switch activation.

BRIEF DISCRIPTION OF THE DRAWINGS

For a more complete understanding of the present invention and for further advantages thereof, reference is now made to the following detailed description taken in conjunction with the accompanying drawings in which.

Figure 5A:
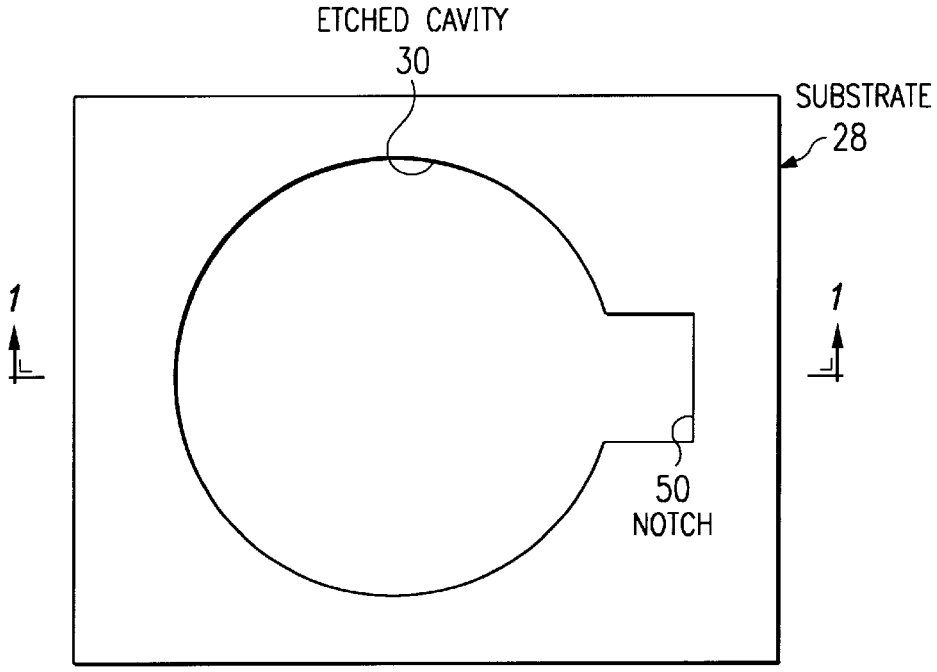

FIG. 5*a* shows a top view of the substrate with the several micron deep cavity etched into it.

Figure 5B:
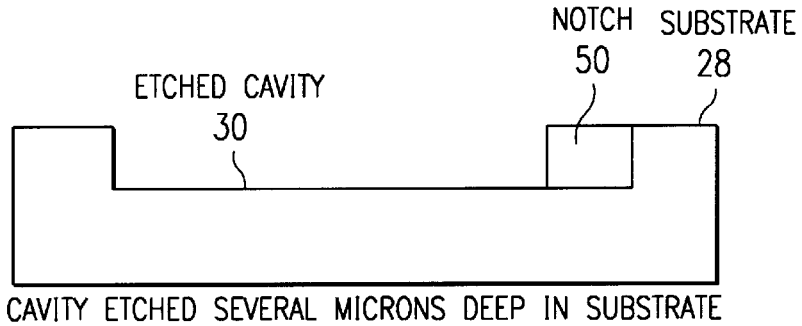

FIG. 5*b* shows a side sectional view of the device of FIG. 5*a* along the section lines 1—1.

Figure 5C:
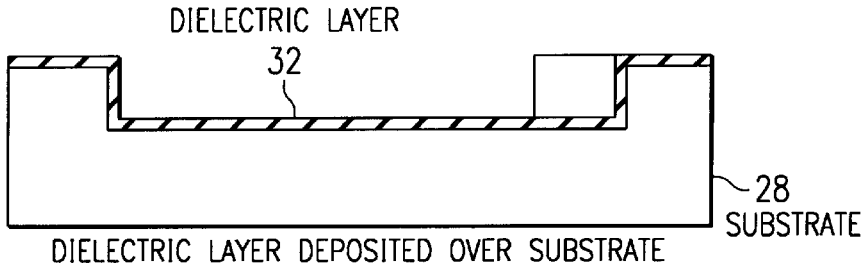

FIG. 5*c* shows the etched cavity with a dielectric insulator layer deposited over the substrate.

Figure 5F:
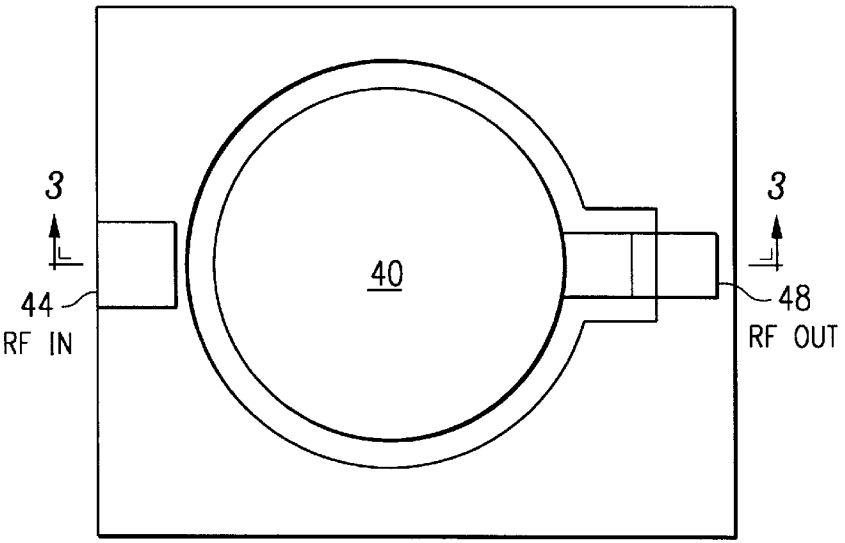
Figure 5G:
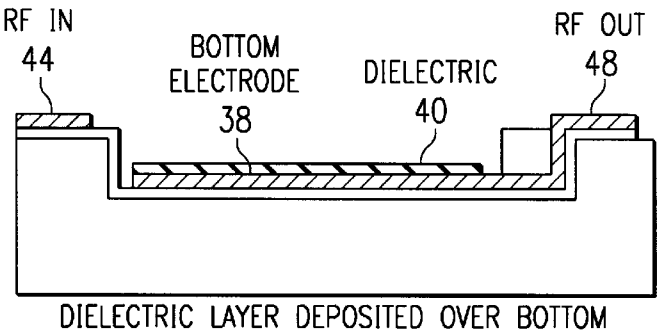
Figure 5D:
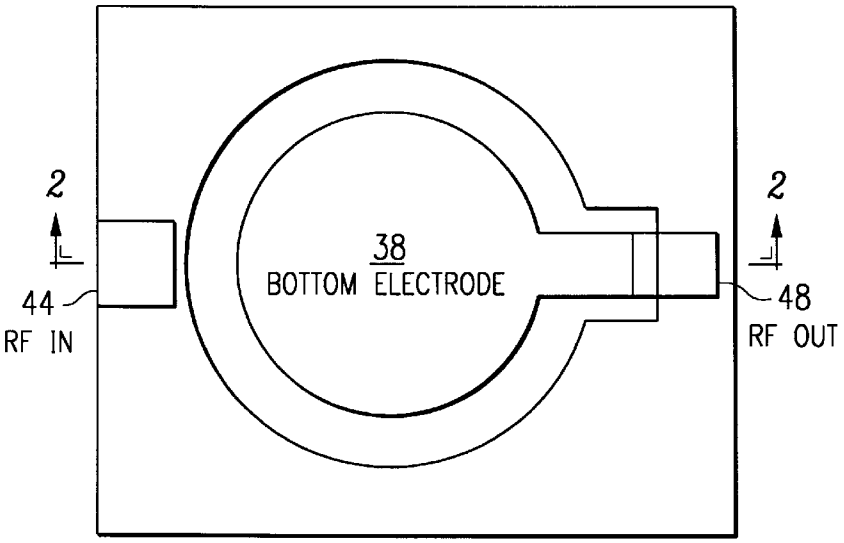

FIG. 5*d* shows a top view of the deposition and patterning of the first level metal which results in the bottom electrode for the RF switch structure.

Figure 5E:
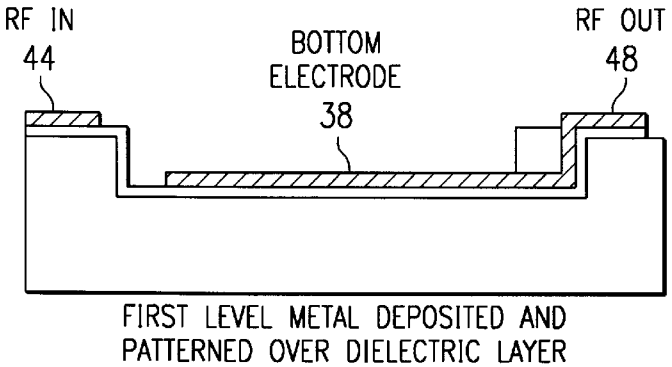

FIG. 5*e* shows a side sectional view of the device of FIG. 5*d* along the section lines 2—2.

FIG. 5*f* shows a top view of a dielectric layer deposited and patterned over the bottom electrode of the RF switch structure.

FIG. 5*g* shows a side sectional view of the device of FIG. 5*f* along the section lines 3—3.

Figure 5J:
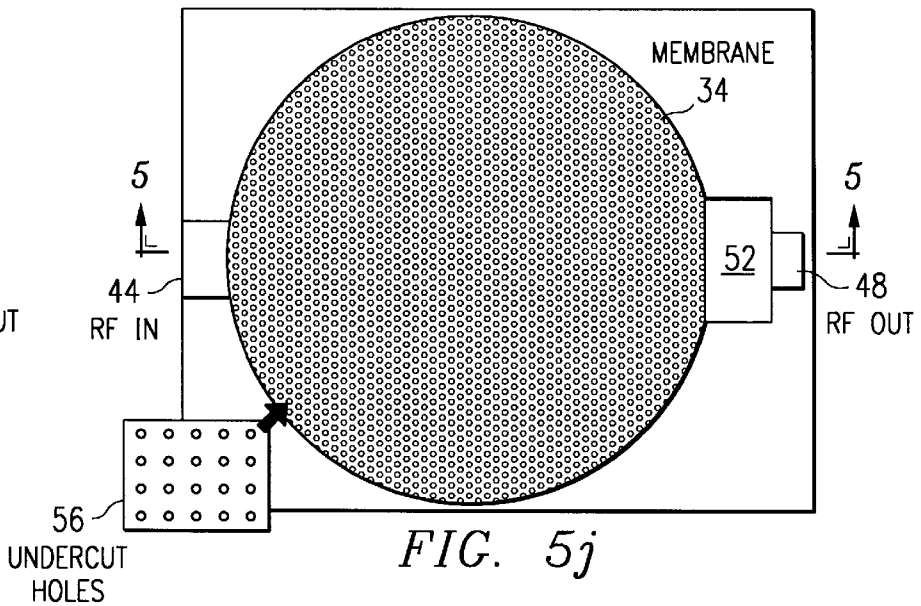
Figure 5K:
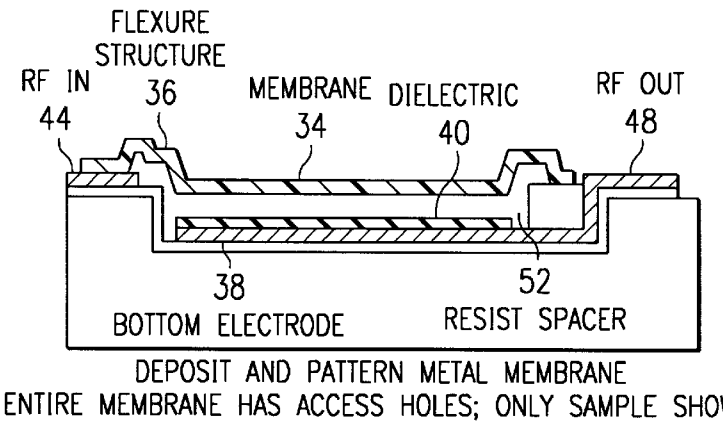
Figure 5H:
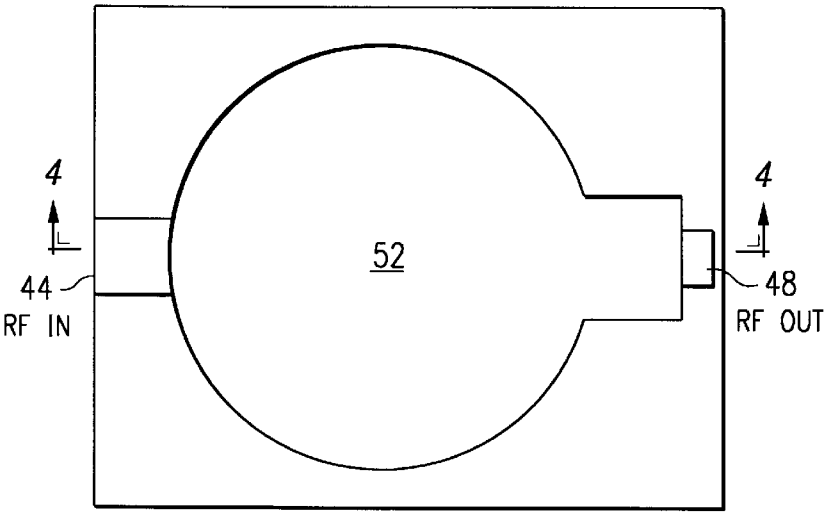

FIG. 5*h* shows a top view of the RF switch structure with a sacrificial resist spacer spun on.

Figure 5I:
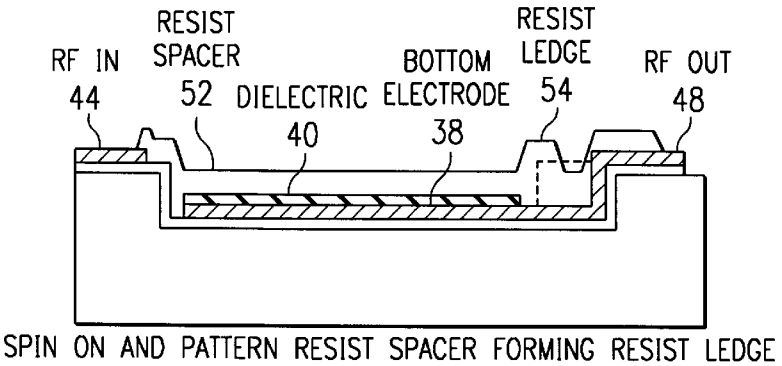

FIG. 5*i* shows a side sectional view of the device of FIG. 5*h* along the section lines 4—4.

FIG. 5*j* shows a top view of the RF switch structure with the second level metal deposited and patterned to form the membrane.

FIG. 5*k* shows a side setional view of the device of FIG. 5*j* along the section lines 5—5.

Figure 5L:
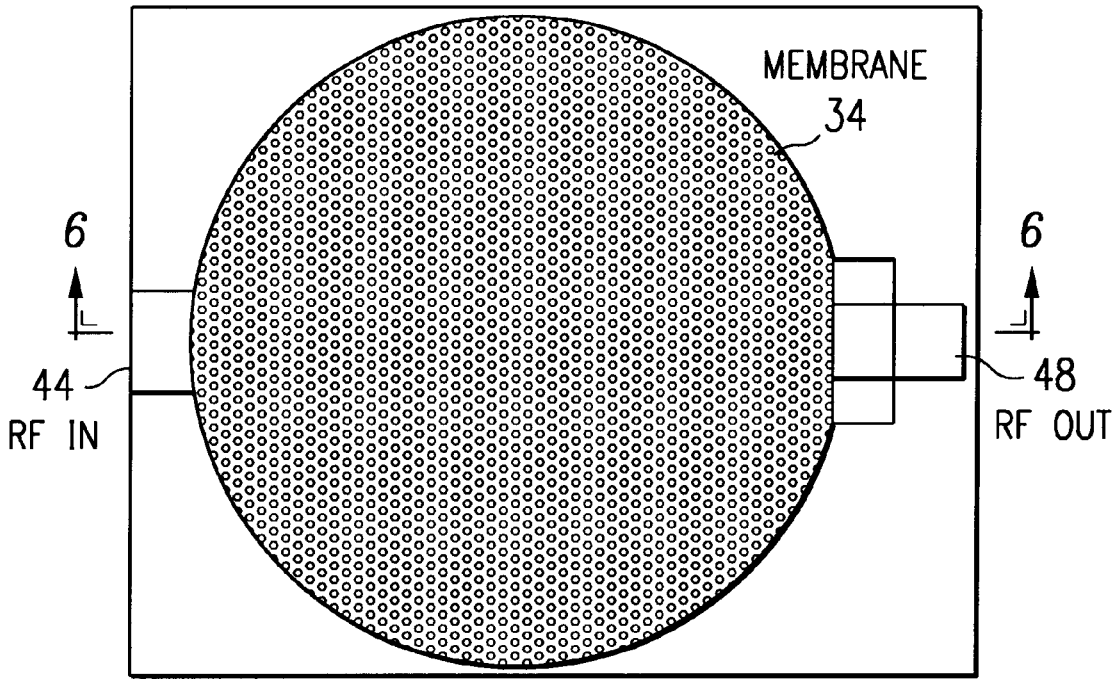

FIG. 5*l* shows a top view of the finished RF switch with the sacrificial spacer removed and the membrane free to move.

Figure 5M:
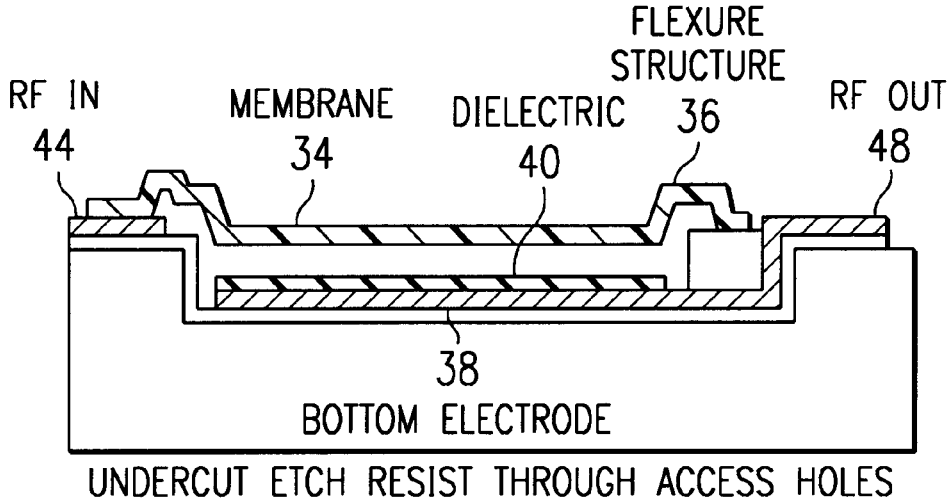

FIG. 5*m* shows a side sectional view of the device of FIG. 5*l* along the section lines 6—6.

DESCRIPTION OF PREFERRED EMBODIMENTS

Figure 1:
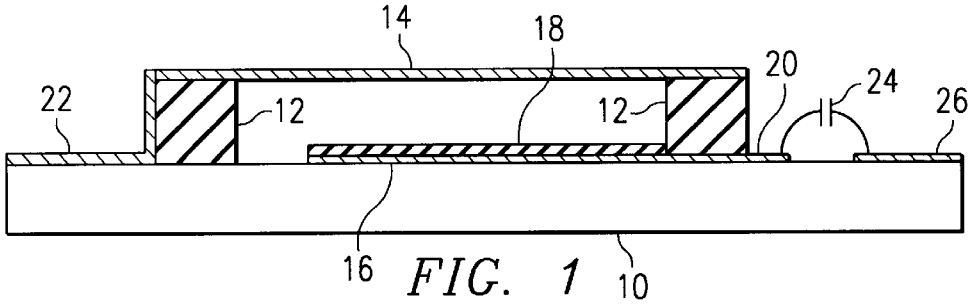
FIG. 1 (PRIOR ART)
FIG. 1 shows the undeflected membrane for a conventional RF switch in the OFF state.
Figure 2:
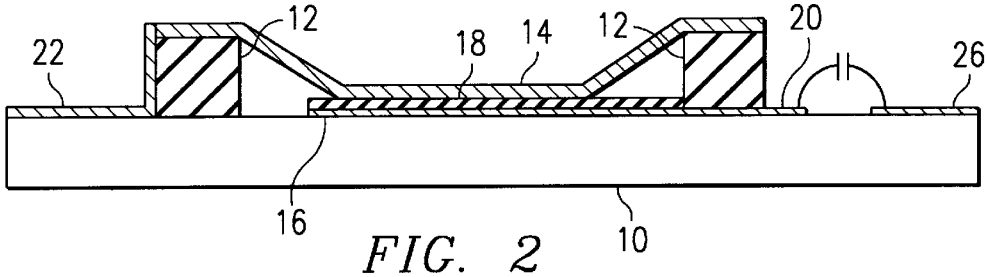
FIG. 2 (PRIOR ART)
FIG. 2 shows the deflected membrane for a conventional RF switch in the ON state.
Figure 3:
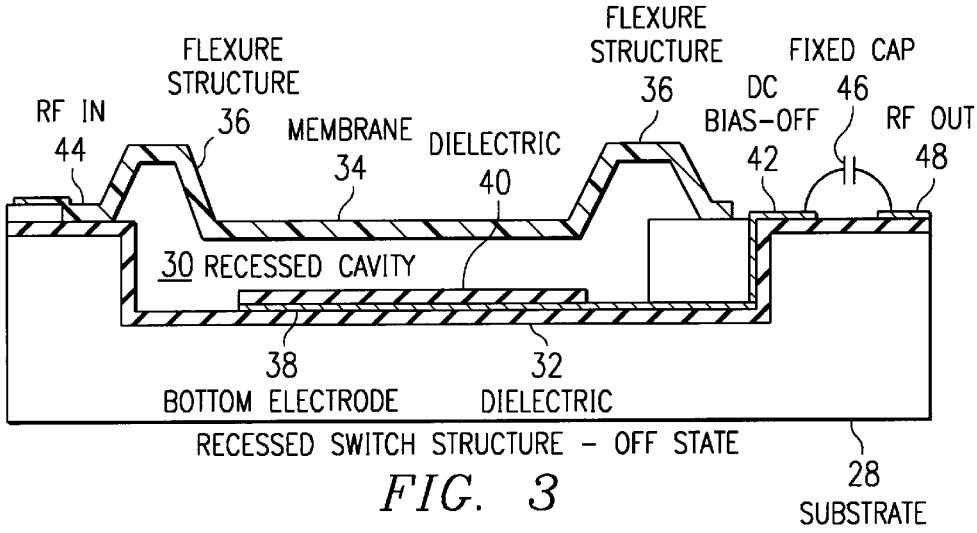
FIG. 3 shows the recessed switch structure of this invention in the OFF state.

FIG. 3 shows the structure for the MEMS RF switch of this invention. The device's substrate 28 has a recessed cavity 30, several microns deep, etched into it. In a general sense, a dielectric 32 layer is shown over the substrate 28 surface to insulate the switch structure from the substrate, although for some substrate materials this layer may not be required. The switch structure is then built in the well of this cavity, as shown. The membrane structure 34 is built on top of the substrate while the bottom electrode 38 and dielectric 40 insulator layer are built on the bottom surface of the cavity 30. Membrane 34 is located in facing relationship to the bottom electrode 38 and in fact, in this preferred embodiment, has a portion oriented in parallel to a portion of electrode 38. However, in this description and in the appended claims, the term "in facing relationship" is not intended to be limited to a parallel orientation but is intended to encompass any relative orientation where the two plates (electrodes) of the capacitor are located in proximity to each other and wherein at least one of the plates may be deflected to a sufficient extent in the direction of the other plate to result in significant capacitance between the plates. The membrane 34 also has a flexure structure 36 built into it's periphery. This flexure structure, which acts much like a spring, provides stress relief for the membrane. The rest of the device, the DC bias 42, RF input 44, fixed capacitance 46 at the output, and RF output 48 are similar to the conventional switch discussed earlier. In this configuration where there is no DC bias 42 applied, the membrane 34 is relaxed, the capacitance is low, and the switch in OFF.

Figure 4:
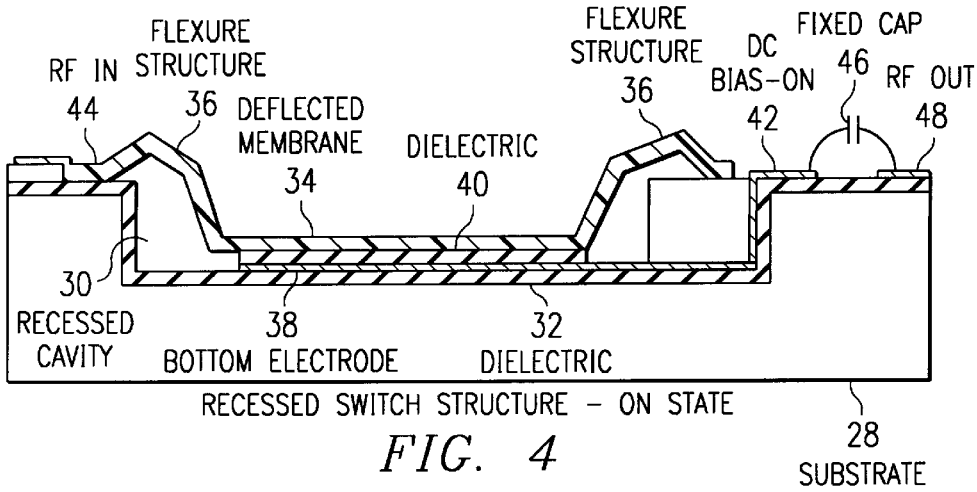
FIG. 4 shows the recessed switch structure of this invention in the ON state.

FIG. 4 shows the same RF switch structure with a DC bias 42 applied. In this case the electrostatic charge causes the membrane 34 to deflect or pull down to the dielectric 40 insulator separating the two electrodes. The stress in the membrane 34 is effectively transferred to the flexure structure 36 which supports the membrane 34 and which is designed to absorb this stress. In this state the capacitance is high and the switch is ON.

The process for fabricating the RF switch of this patent uses standard integrated circuit manufacturing techniques which are well known in the art. This process is illustrated in FIGS. 5*a*–5*m* with both top and cross sectional views. As shown in FIGS. 5*a* and 5*b,* a recessed cavity 30 is patterned and then etched several microns deep into substrate 28. This cavity is shown as circular, although other shapes could be used. A notch 50 extends the cavity on one side to accommodate the RF output connection and isolation between the two electrodes. There are numerous well known reactive ion etching (RIE) techniques which can be used to produce substantially vertical sidewalls and smooth etched surfaces. A typical depth of this cavity is on the order of 4 microns.

Any number of substrate materials can be used to build the switch structure. Depending on the substrate material used, it may be necessary to put down a dielectric layer 32, as shown in FIG. 5*c,* over the substrate 28 in order to isolate the switch electrodes and input/output connections. GaAs is a good choice for the substrate material when working in the RF domain. Its semi-insulating properties provide a very low loss substrate for RF signals and, as a result, it can be used without a dielectric material under the electrodes. In a general sense, the dielectric layer is shown in the cross sectional views but omitted in the top views for clarity.

FIGS. 5*d* and 5*e* show the build-up of the switch structure through the bottom metal electrode step. A metal layer is deposited on the wafer by sputter coating or other deposition technique. Sputter coating has the advantage of good step coverage over the edge of the etched region. Aluminum is one choice for the deposited metal, although any number of other metals could be used. A lithographic step is used to define the bottom metal electrode 38, along with the input and output pads 44 and 48, and then the metal is etched by means of a wet chemical or dry etching technique.

A dielectric layer 40 is then deposited on the wafer as indicated in FIGS. 5*f* and 5*g*. Plasma enhanced deposition of silicon nitride is a suitable choice for the layer. A lithography and etching step is then used to pattern and etch the nitride layer leaving the dielectric 40 covering the bottom electrode 38 in the area at the bottom of the recessed cavity.

Next, as shown in FIGS. 5*h* and 5*i,* a layer of photoresist 52 is spun on and defined by lithography. The spin rate and resist type are selected to produce the desired spacing of the membrane over the bottom electrode. Because the photoresist pattern extends well outside the etched cavity and the resist will not completely planarize, there will be a resist thickness on the top surface of the substrate which is similar in thickness to the resist in the etched cavity. This rim around the membrane is referred to as the "resist ledge" 54. Unlike a process that uses the resist spacer as the eventual post material, this resist layer is completely sacrificial and will be totally removed later in the process. As a result, the photoresist spacer 52 does not need to have all the properties that would be required for a material which would remain in the completed device. This feature provides a great deal of flexibility in processing the RF switch device.

Next, as shown in FIGS. 5*j* and 5*k,* a metal layer is deposited over the wafer. Sputtered Aluminum is a reasonable choice for this metal, although other metals could be used. A pattern is formed lithographically and the metal is etched either by wet etching or with the RIE technique discussed earlier, to form the metal membrane 34 over the resist spacer 52. Note that the metal deposited over the resist ledge around the periphery of the device forms the flexure structure 36 which supports the membrane and provides the desired stress relief. A series of small holes 56 are included in the membrane, a small section of which is shown in the exploded blow-up, wherever there is resist under the membrane, but not included around the edge of the device where the membrane sits directly on the substrate. Any number of hole patterns could be used to provide access for the undercut etch process, for example holes which are 2 microns in diameter and separated by 7×7 microns from center to center in both vertical and horizontal directions.

Finally, as illustrated in FIGS. 5*l* and 5*m,* the resist spacer layer 52 is undercut from underneath the membrane using an anisotropic dry etch. The undercut holes in the membrane, discussed above, are used for plasma dry etch access and a path for etching away the photoresist spacer from below the membrane. The end result is a membrane with an annular flexure structure 36 which is free to move up and down as the switch is turned on and off.

While the invention has been described in the context of a preferred embodiment, it will be apparent to those skilled in the art that the present invention may be modified in numerous ways and may assume many embodiments other than that specifically set out and described above. Accordingly, it is intended by the appended claims to cover all modifications of the invention which fall within the true spirit and scope of the invention.

What is claimed is:

1. An electromechanical switch comprising:

a) a substrate having a circular cavity formed therein, including a notched area in said substrate adjacent a sidewall surface of said cavity;

b) a first conductive material, at least a portion thereof being located in said cavity;

c) a second conductive material spaced from said first conductive material, at least a portion of at least one of said first and second conductive materials being deflectable toward the other conductive material in response to a voltage being applied to said first conductive material; and d) an insulating material within said cavity located intermediate at least portions of said first and second conductive materials, said insulating material spacing said first conductive material from said second conductive material when said at least one of said first and second conductive material is deflected toward the other conductive material.

2. The electromechanical switch of claim 1, wherein said notched area provides access for said first conductive material to extend into said cavity.

3. An electromechanical switch comprising:

a) a substrate having a cavity formed therein;

b) a first conductive material, at least a portion thereof being located in said cavity;

c) an insulating material between said first conductive material and said substrate;

d) a second conductive material spaced from said first conductive material, at least a portion of at least one of said first and second conductive materials being deflectable toward the other conductive material in response to a voltage being applied to said first conductive material; and e) an insulating material within said cavity located intermediate at least portions of said first and second conductive materials, said insulating material spacing said first conductive material from said second conductive material when said at least one of said first and second conductive material is deflected toward the other conductive material.

4. The electromechanical switch of claim 3, wherein at least one of said first and second conductive materials has a portion thereof affixed to said substrate and includes a flexure structure intermediate said portion thereof and a remainder of the conductive material.

5. The electromechanical switch of claim 4, wherein said flexure structure is annular in shape.

6. The electromechanical switch of claim 3, wherein said cavity is circular in shape.

7. The electromechanical switch of claim 3, wherein said second conductive material is spaced from said first conductive material in a parallel orientation.

8. The electromechanical switch of claim 3, wherein said voltage is a DC bias voltage.

9. An electromechanical switch comprising:

a) a single substrate, said substrate having a cavity formed in at least one face thereof;

b) an insulating material on at least a bottom surface of said cavity;

c) a first conductive material, at least a portion thereof being formed on said insulating material;

d) a second conductive material located in a vicinity of said first conductive material, said second conductive material being affixed to said substrate in areas other than said cavity, said second conductive material comprising a flexure structure and a membrane structure in which said flexure structure is in an area other than the area where said second conductive material is affixed to said substrate; and e) a second insulating material within said cavity and in contact with said first conductive material, said second insulating material being intermediate at least said first conductive material and said membrane structure of said second conductive material.

10. A device, comprising:

a) a substrate having a cavity formed therein, including a notched area in said substrate adjacent a side wall surface of said cavity;

b) an electrode, at least a portion thereof being located adjacent a bottom surface of said cavity; and c) a conductive membrane spaced from said electrode, said conductive membrane comprising a flexure structure and a membrane structure, said membrane structure being deflectable toward said electrode in response to a voltage being applied to said electrode.

11. The device of claim 10 wherein said voltage is a DC voltage.

12. The device of claim 10 wherein a plane of a top surface of said flexure structure changes in response to said membrane structure being deflectable toward said electrode in response to a voltage being applied to said electrode.

13. The device of claim 10 further including an insulating material spacing said electrode from said membrane structure when said membrane structure is deflected toward said electrode.

14. The device of claim 10 wherein said flexure structure is annular in shape.

15. The device of claim 10, wherein said cavity is circular in shape.

16. The device of claim 10, wherein said notched area provides access for said electrode to extend into said cavity.

17. The device of claim 10, wherein said membrane structure is spaced from said electrode in a parallel orientation.

18. The device of claim 10, wherein said device is a micro-electro-mechanical RF switch.

19. A device, comprising:

a) a substrate having a cavity formed therein;

b) an insulating material on a bottom surface of said cavity;

c) an electrode, at least a portion thereof being located adjacent said insulating material; and d) a conductive membrane spaced from said electrode, said conductive membrane comprising a flexure structure and a membrane structure, said membrane structure being deflectable toward said electrode in response to a voltage being applied to said electrode.

20. The device of claim 19, wherein said flexure structure is annular in shape.

21. The device of claim 19, wherein said cavity is circular in shape.

22. The device of claim 19, wherein said membrane structure is spaced from said electrode in a parallel orientation.

23. The device of claim 19, wherein said device is a micro-electro-mechanical RF switch.

* * * * *